United States Patent [19]

Cloutier et al.

[11] 4,331,081

[45] May 25, 1982

[54] EXPLOSIVE BOOSTER

[75] Inventors: Joseph A. R. Cloutier, Montreal; Anthony C. F. Edmonds, Mont St. Hilaire, both of Canada

[73] Assignee: C-I-L Inc., Willowdale, Canada

[21] Appl. No.: 172,163

[22] Filed: Jul. 25, 1980

[51] Int. Cl.[3] ..... F42B 3/00

[52] U.S. Cl. ..... 102/318; 102/322; 102/286

[58] Field of Search ..... 102/318, 322, 285, 286; 149/105

[56] References Cited

U.S. PATENT DOCUMENTS

| | | | |
|---|---|---|---|
| 3,285,172 | 11/1966 | Foster | 102/318 X |
| 3,288,065 | 11/1966 | Tousley, Jr. | 102/318 |
| 3,437,038 | 4/1969 | Newman | 102/318 |
| 3,451,339 | 6/1969 | Precoul | 102/205 X |
| 3,754,061 | 8/1973 | Forrest et al. | 149/105 X |
| 3,880,080 | 4/1975 | Cook | 102/318 |
| 4,060,033 | 11/1977 | Postupack et al. | 102/318 |

*Primary Examiner*—Peter A. Nelson

[57] ABSTRACT

An explosive booster is provided for the detonation of insensitive blasting agents. The booster contains TNT as the sole explosive ingredient, is sensitive to blasting cap initiation yet remains insensitive to impact initiation. The booster comprises an elongate structure having a gradually increasing density from end to end, only the less dense end being cap sensitive. Reduced density is accomplished by the incorporation of voids or pockets, by means of, for example, glass microspheres. Particulate sodium nitrate and vermiculite are included as density enhancers.

8 Claims, 2 Drawing Figures

EXPLOSIVE BOOSTER

This invention relates to an explosive booster used for the detonation of explosive compositions which are insensitive to detonation by ordinary blasting caps. Typical of such cap-insensitive explosives are, for example, ammonium nitrate/fuel oil (ANFO) mixtures and aqueous slurry blasting agents.

Figure 1:
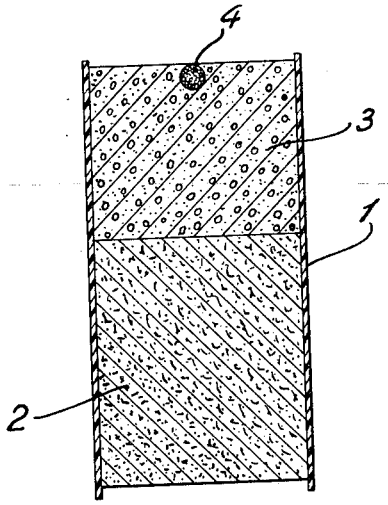
FIG. 1 is a cross section of the explosive booster with a solid cast primer.

A large variety of booster types are known in the explosives art. Most boosters employed with cap-insensitive blasting agents comprise a cast or pressed cap-sensitive high explosive charge usually having a recess or well adapted to receive a blasting cap or other initiator such as a length of detonating cord. Sometimes such cast or pressed boosters comprise a core of explosive which is sensitive to detonating cord or cap initiation, which core is itself surrounded by a sheath of non-cap-sensitive explosive. Such a core-and-sheath booster is disclosed, for example, in U.S. Pat. No. 3,037,452. Other typical cast or pressed boosters are disclosed in U.S. Pat. Nos. 3,037,453, 3,341,382, 3,371,606, 3,491,688, 3,437,038, 3,359,902, 3,604,353, 3,604,354 and 4,009,060. In general, all of the aforedisclosed boosters are water-resistant and are generally insensitive to initiation from impact. They are, however, not without some limitations and disadvantages. In substantially all cases the explosives of choice for cast and pressed boosters is trinitrotoluene (TNT) because of its relatively cheap cost and ready availability. However, since TNT is, except under unusual conditions, insensitive to blasting cap or detonating cord initiation, it has been necessary to combine with the TNT an amount of another cap-sensitive explosive in order to insure initiation of the TNT. This combination may be in the nature of a sensitive core material surrounded by the TNT sheath or it may be made by placing sensitive explosive in side-by-side abutment with the TNT. Alternatively the TNT may be made more sensitive by mixing a sensitive material with the TNT to form a cap-sensitive combination. Typical of the cap-sensitive materials which may be combined or mixed with TNT are, for example, pentaerythritol tetranitrate (PETN) and cyclonite (RDX).

It will be obvious that the manufacture of two-component boosters, of say, a PETN core surrounded by a TNT sheath, will be substantially more costly than a single cast or single press booster of, say, TNT alone. Not only does the two-component booster require additional manufacturing steps but also the cost of the cap-sensitive ingredient, for example, PETN, is substantially greater than the cost of an equivalent volume of TNT. In addition, because of the presence of cap-sensitive PETN or the like, the manufacture and the use of the multi-component booster carries with it an additional risk or hazard factor.

A method has now been found for manufacturing a cast booster comprising TNT alone as the only self-explosive material which booster is sensitive to blasting cap and detonating cord initiation, is insensitive to accidental initiation by impact and is cheap to manufacture.

It has been surprisingly discovered that by controlling or maintaining the density of cast TNT to a value not greater than 1 $Mg/m^3$ by the inclusion therein of discrete voids or gaseous pockets, a booster charge may be provided which is sensitive to blasting cap initiation. It has been noted, however, that the detonation wave generated by the initiation of low density TNT of 1 $Mg/m^3$ or less is of a low intensity and is not adequate for the initiation of regular or normal density cast TNT in contact with it or for the initiation of an adjacent insensitive blasting agent. It is postulated that the density difference at the interface between the low density TNT and an adjacent insensitive explosive, creates an impedance discontinuity which tends to reflect away a substantial amount of the energy of the detonation wave generated by the low density TNT thus preventing boostering. To overcome this difficulty, the booster of the present invention comprises an elongated TNT casting of gradually increasing density from end to end. The means by which the gradually increasing density may be conveniently created during the period of solidification and cooling of the casting of the void-containing TNT is by the incorporation in the molten TNT of particulate sodium nitrate and particulate expanded vermiculite and gas bubbles. The booster of the invention is preferably adapted for the convenient attachment or insertion of the initiating cap or detonating cord against or within the most sensitive low density portion of the casting. The addition of particulate sodium nitrate, preferably having a grit size of less than 20 mesh-Tyler and in an amount of up to 20% by weight of the total booster, provides for an increase in the overall density of the cast booster without reducing its sensitivity or its energy output.

From computed values of detonation pressure obtained from TNT containing up to 20% by weight of particulate sodium nitrate, it can be observed that no substantial reduction in detonation pressure takes place from that observed with unadulterated TNT. It is, therefore, possible to prepare practical and useful primers of the type described herein without the need of any separately cast TNT portion. The addition of particulate expanded vermiculite (filter grade) to a castable TNT/sodium nitrate mixture tends to slow the settling of the sodium nitrate and any solid void-containing material during the period of cooling and solidification of the TNT blend.

The incorporation of the discrete voids within the TNT casting is most easily accomplished by adding to the molten TNT sufficient glass microspheres to achieve the desired low density and the resulting sensitization. Such glass microspheres, especially in the presence of particulate expanded vermiculite, tend to settle only very slowly as the TNT solidifies thus producing a gradual decreasing density from top to bottom in the final cast product. Discrete voids may also be incorporated in the TNT casting by the mechanical "whipping-in" of air or by the addition of particulate gas-generating materials such as, for example, sodium borohydride. While the addition of whipped-in air or the generation of gas in situ have the obvious advantage of economy over the use of glass microspheres, it will be appreciated that difficulties may be encountered in providing a controlled distribution and sizing of whipped-in or generated gas bubbles.

A further aspect of the present invention provides for a combination booster comprising a mixture of TNT and one other cap-sensitive solid castable explosive wherein the quantity of the cap-sensitive castable explosive can be substantially reduced by the incorporation in the mixture of discrete voids.

Figure 2:
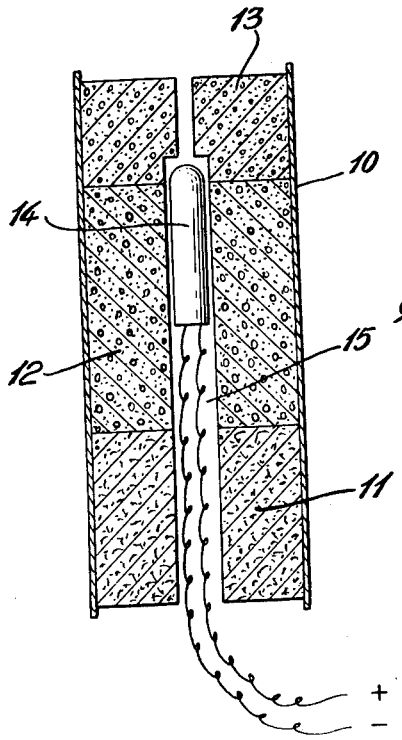
FIG. 2 is a cross section containing an axial tunnel in said primer.

The following examples taken in conjunction with the attached drawings which show in FIG. 1 a solid cast TNT primer of the invention and in FIG. 2 a TNT cast primer of the invention having an axial tunnel or cap well, illustrate the invention. The percentage of each constituent is expressed by weight of dry material.

EXAMPLE 1

With particular reference to FIG. 1, into a two inch diameter×five and one-half inch long paper or plastic cyclinder 1 was poured a three inch column of full density TNT 2 which was allowed to solidify but was maintained at a temperature of 75° C. The remaining space 3 in the cylinder was filled with a mixture of TNT (77%), glass microspheres (3.8%), filter grade expanded vermiculite (3.8%) and particulate (passing 20 mesh) sodium nitrate (15.4%). The initial pouring temperature of the mixture was from 85°–97° C. A length of reinforced detonating cord 4, containing 10 g/m of PETN was set in place at the upper surface of the molten mixture in space 3 and the entire casting was allowed to cool and solidify by natural convection in air at 20°–25° C.

On initiation of the detonating cord 4 by means of an electric blasting cap, the whole assembly detonated. From chronometer readings it was evident that the full density portion of the TNT was detonated at its normal high velocity. Further evidence of complete detonation was obtained through observation of a normal size of crater formed in a mild steel plate placed under the booster. A similar cylindrical casting of TNT devoid of glass microspheres, vermiculite and sodium nitrate failed to initiate in contact with 10 g/m detonating cord.

EXAMPLE 2

With particular reference to FIG. 2, a cardboard cylinder 10, two inches in diameter×seven inches long and containing a removable central coaxial pin of about five-sixteenths inch diameter (not shown) was filled in three stages. A base portion comprising a two and one-half inch column of unadulterated full density TNT was cast. On top of this, a three inch column 12 of gradually increasing density TNT was cast with the greater density portion in contact with the previously cast unadulterated TNT. The gradually increasing density TNT, which tends towards segregation upon cooling, was comprised of the same mixture as described in Example 1. On top of this segregating portion was cast a one and one-half inch column 13 of TNT containing 10.5% by weight of glass microspheres of grade C15/250 manufactured by 3M. Cooling of the upper TNT/microspheres portion was effected quickly to prevent segregation and to maintain a constant low density throughout. After cooling, the coaxial pin was removed and the booster was detonated by means of an electric blasting cap 14 placed within the co-axial channel or tunnel 15 and close to the interface of the low density and the increasing density portions of the casting. On detonation upon a one inch thick mild steel plate a crater was produced indicating complete detonation at high velocity. A booster of similar dimensions but comprised of unadulterated TNT could not be initiated with a similar electric blasting cap.

It will be obvious to those skilled in the art that graduated density initiator charges of the type described in the present invention can be prepared from any castable explosive mixture. While no particular advantage will accrue in the use of castable explosive material in a cap sensitive range at natural full density (e.g. composition B or Pentolite), the use of voids introduced in the manner described herein will allow reductions in the quantity of sensitive component employed and thus in cost of booster.

What we claim is:

1. A cast booster for detonating insensitive blasting charges and containing trinitrotoluene as the sole explosive ingredient, which booster is sensitive to initiation by blasting cap, the said booster comprising an elongate structure of solidified trinitrotoluene having a cap-insensitive dense end portion and an opposite cap-sensitive less dense end portion, the density of the trinitrotoluene at the less dense end being not greater than one megagram per cubic meter and the density throughout the elongate structure having a gradually increasing value from the less dense cap-sensitive end to the dense cap-insensitive end.

2. An elongate cast booster as claimed in claim 1 having gaseous pockets dispersed substantially from end to end therethrough as a means of providing the said gradually increasing density.

3. A cast booster as claimed in claim 2 wherein the said gaseous pockets comprise glass microspheres.

4. A cast booster as claimed in claim 2 wherein the said gaseous pockets comprise bubbles of occluded gas.

5. A cast booster as claimed in claim 1 also containing minor amounts of a density enhancing material comprising a mixture of particulate sodium nitrate and particulate expanded vermiculite.

6. A cast booster as claimed in claim 1 also containing an amount of a cap-sensitive castable explosive.

7. A cast booster as claimed in claim 5 wherein the particulate sodium nitrate has a grain size of less than 20 mesh-Tyler.

8. A cast booster as claimed in claim 1 having an aperture therein to accommodate a blasting cap.

* * * * *